US009445706B2

(12) United States Patent
Kangas et al.

(10) Patent No.: US 9,445,706 B2
(45) Date of Patent: Sep. 20, 2016

(54) DISHWASHER

(71) Applicant: Whirlpool Corporation, Benton Harbor, MI (US)

(72) Inventors: William K. Kangas, Buchanan, MI (US); Praveen Poojary, Saint Joseph, MI (US); Michael S. Seeley, South Haven, MI (US); Blayne C. Smith, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 10 days.

(21) Appl. No.: 14/164,557

(22) Filed: Jan. 27, 2014

(65) Prior Publication Data

US 2015/0208897 A1 Jul. 30, 2015

(51) Int. Cl.
*A47L 15/16* (2006.01)
*A47L 15/42* (2006.01)

(52) U.S. Cl.
CPC ..... *A47L 15/4219* (2013.01); *A47L 15/16* (2013.01); *A47L 15/4246* (2013.01); *A47L 15/428* (2013.01)

(58) Field of Classification Search
USPC ..... 134/113
See application file for complete search history.

(56) References Cited

U.S. PATENT DOCUMENTS 3,915,180 A * 10/1975 Jacobs ..... A47L 15/4242 134/108
5,979,472 A * 11/1999 Lowery ..... A47L 15/30 134/102.3
7,578,303 B2 8/2009 Daume et al.
8,382,304 B2 2/2013 Wegener et al.
2009/0044846 A1* 2/2009 Rosenbauer ..... A47L 15/4246 134/58 D
2009/0301530 A1* 12/2009 Shin ..... A47L 15/4242 134/58 D
2010/0218793 A1* 9/2010 Olesen ..... A47L 15/4246 134/58 DL
2011/0149551 A1* 6/2011 Camarillo Fernandez ..... F24C 15/02 362/92
2011/0215689 A1* 9/2011 Wegener ..... A47L 15/4246 312/228.1
2012/0138092 A1* 6/2012 Ashrafzadeh et al. ..... 134/18

FOREIGN PATENT DOCUMENTS

DE 102011122897 A1 3/2013
EP 2366323 A1 * 9/2011
EP 2543307 A1 * 1/2013
EP 2581026 A2 4/2013
EP 2394557 B1 5/2013
EP 2596737 A1 5/2013
WO 2013053823 A1 4/2013
WO 2013053829 A1 4/2013

OTHER PUBLICATIONS

EP 2366323 A1, Hanitz C et al. English translation.*
EP 2543307 A1, Rehm K et al. English translation.*
European Search Report for Counterpart EP15151660.6, dated Jun. 12, 2015.

* cited by examiner

*Primary Examiner* — Michael Barr
*Assistant Examiner* — Cristi Tate-Sims

(57) ABSTRACT

A dishwasher for treating dishes includes a tub at least partially defining a treating chamber, a spraying system having a distribution header and at least one aperture provided on the distribution header for spraying wash liquid into the treating chamber, and a recirculation system for recirculating liquid sprayed in the treating chamber to the spraying system. A light assembly is provided on the distribution header, and includes a light source that emits light to a light guide, which in turn distributes light to the treating chamber.

20 Claims, 13 Drawing Sheets

DISHWASHER

BACKGROUND OF THE INVENTION

Contemporary automatic dishwashers for use in a typical household include a tub and at least one rack or basket for supporting soiled dishes within the tub. A spraying system may be provided for recirculating liquid throughout the tub to remove soils from the dishes. The treating chamber of the dishwasher can be illuminated, such as by providing a light on the interior of the dishwasher. For example, existing lighting solutions place a single point of light on a wall of the tub, which does not evenly illuminate all areas of the treating chamber or provide high aesthetic value. Other existing solutions place multiple lights inside the dishwasher, but this requires that the entire lighting assembly be sealed to prevent moisture from reaching any of the electronics of the lights.

BRIEF DESCRIPTION OF THE INVENTION

The invention relates to a dishwasher for treating dishes according to an automatic cycle of operation. In one aspect of the invention, the dishwasher includes a tub at least partially defining a treating chamber and having an open face providing access to the treating chamber, a cover selectively closing the open face, a spraying system including a distribution header and at least one aperture provided on the distribution header for spraying wash liquid into the treating chamber, a recirculation system for recirculating liquid sprayed in the treating chamber to the spraying system, and a light assembly including a first light source and a first light guide provided on the distribution header. The first light source emits light to the first light guide and first light guide distributes light to the treating chamber.

DESCRIPTION OF EMBODIMENTS OF THE INVENTION

Figure 1:
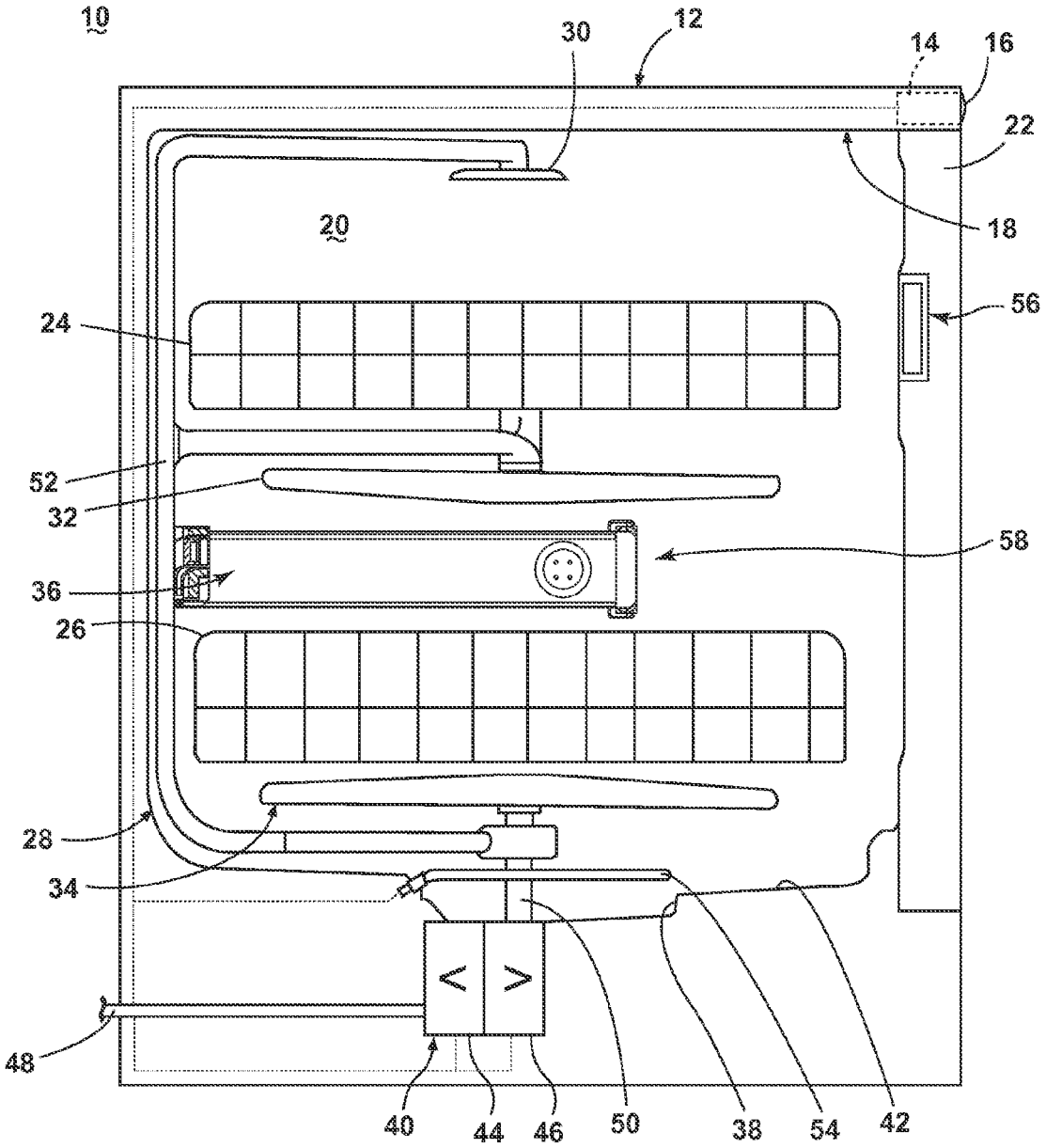
FIG. 1 is a schematic, cross-sectional view of a dishwasher with a light assembly according to a first embodiment of the invention.

In FIG. 1, an automated dishwasher 10 according to one embodiment of the invention is illustrated. The dishwasher 10 can treat dishes according to an automatic cycle of operation. Depending on whether the dishwasher 10 is a stand-alone or built-in, the dishwasher includes a cabinet 12 that may be a chassis/frame with or without panels attached, respectively. The dishwasher 10 shares many features of a conventional automatic dishwasher, which will not be described in detail herein except as necessary for a complete understanding of the invention. While the present invention is described in terms of a conventional dishwashing unit, it could also be implemented in other types of dishwashing units, such as in-sink dishwashers, multi-tub dishwashers, or drawer-type dishwashers.

A controller 14 may be located within the cabinet 12 and may be operably coupled with various components of the dishwasher 10 to implement one or more cycles of operation. A control panel or user interface 16 may be provided on the dishwasher 10 and coupled with the controller 14. The user interface 16 may include operational controls such as dials, lights, switches, and displays enabling a user to input commands, such as a cycle of operation, to the controller 14 and receive information.

A tub 18 is located within the cabinet 12 and at least partially defines a treating chamber 20 with an access opening in the form of an open face. A cover, illustrated as a door 22, may be hingedly mounted to the cabinet 12 and may move between an opened position, wherein the user may access the treating chamber 20, and a closed position, as shown in FIG. 1, wherein the door 22 covers or closes the open face of the treating chamber 20.

Dish holders in the form of upper and lower dish racks 24, 26 are located within the treating chamber 20 and receive dishes for being treated. The racks 24, 26 are mounted for slidable movement in and out of the treating chamber 20 for ease of loading and unloading. As used in this description, the term "dish(es)" is intended to be generic to any item, single or plural, that may be treated in the dishwasher 10, including, without limitation; utensils, plates, pots, bowls, pans, glassware, and silverware. While not shown, additional utensil holders, such as a silverware basket on the interior of the door 22, may also be provided.

A spraying system 28 may be provided for spraying liquid into the treating chamber 20 and is illustrated in the form of an upper sprayer 30, a mid-level rotatable sprayer 32, a lower rotatable sprayer 34, and a distribution header 36. The upper sprayer 30 may be located above the upper rack 24 and is illustrated as a fixed spray nozzle that sprays liquid downwardly within the treating chamber 20. The mid-level rotatable sprayer 32 is located between the upper rack 24 and the lower rack 26 and is illustrated as a rotating spray arm. The mid-level spray arm 32 may provide a liquid spray upwardly through the bottom of the upper rack 24. The mid-level rotatable sprayer 32 may optionally also provide a liquid spray downwardly onto the lower rack 26, but for purposes of simplification, this will not be illustrated herein. The lower rotatable sprayer 34 is located underneath the lower rack 26 and may provide a liquid spray upwardly through the bottom of the lower rack 26.

The distribution header 36 may be fixedly mounted to the tub 18 adjacent one of both of the racks 24, 26, and as shown herein is provided between the racks 24, 26. The distribution header 36 may not be limited to this position; rather, the distribution header 36 may be located in virtually any part of the treating chamber 20.

A liquid recirculation system may be provided for recirculating liquid from the treating chamber 20 to the spraying system 28. The recirculation system may include a sump 38 and a pump assembly 40. The sump 38 collects the liquid sprayed in the treating chamber 20 and may be formed by a sloped or recessed portion of a bottom wall 42 of the tub 18. The pump assembly 40 may include both a drain pump 44 and a recirculation pump 46.

The drain pump 44 may draw liquid from the sump 38 and pump the liquid out of the dishwasher 10 to a household drain line 48. The recirculation pump 46 may draw liquid from the sump 38 and pump the liquid to the spraying system 28 to supply liquid into the treating chamber 20. While the pump assembly 40 is illustrated as having separate drain and recirculation pumps 44, 46 in an alternative embodiment, the pump assembly 40 may include a single pump configured to selectively supply wash liquid to either the spraying system 28 or the drain line 48, such as by configuring the pump to rotate in opposite directions, or by providing a suitable valve system. While not shown, a liquid supply system may include a water supply conduit coupled with a household water supply for supplying water to the sump 38.

As shown herein, the recirculation pump 46 has an outlet conduit 50 in fluid communication with the spraying system 28 for discharging wash liquid from the recirculation pump 46 to the sprayers 30-36. As illustrated, liquid may be supplied to the distribution header 36, mid-level rotatable sprayer 32, and upper sprayer 30 through a supply tube 52 that extends generally rearward from the recirculation pump 46 and upwardly along a rear wall of the tub 18. While the supply tube 52 ultimately supplies liquid to the distribution header 36, mid-level rotatable sprayer 32, and upper sprayer 30, it may fluidly communicate with one or more manifold tubes that directly transport liquid to the distribution header 36, mid-level rotatable sprayer 32, and upper sprayer 30. Further, diverters (not shown) may be provided within the spraying system 28 such that liquid may be selectively supplied to each of the sprayers 30-36. The sprayers 30-36 spray water and/or treating chemistry onto the dish racks 24, 26 (and hence any dishes positioned thereon) to effect a recirculation of the liquid from the treating chamber 20 to the liquid spraying system 28 to define a recirculation flow path.

Additional functional systems may be provided for the dishwasher 10. For example, a heating system having a heater 54 may be located within or near the sump 38 for heating liquid contained in the sump 38. A dispensing system 56, which may dispense a detergent during the wash step of the cycle of operation or a rinse aid during the rinse step of the cycle of operation, may be located within the dishwasher 10, such as on an inner surface of the door. A filtering system (not shown) may be fluidly coupled with the recirculation flow path for filtering the recirculated liquid.

A light assembly 58 may be provided inside the cabinet 12 for selectively illuminating the treating chamber 20. The light assembly 58 can be at least partially provided on the distribution header 36 within the tub 18, and can illuminate one or both of the racks 24, 26. As shown herein, the light assembly is provided between the racks 24, 26 and illuminates both of the racks 24, 26.

Figure 2:
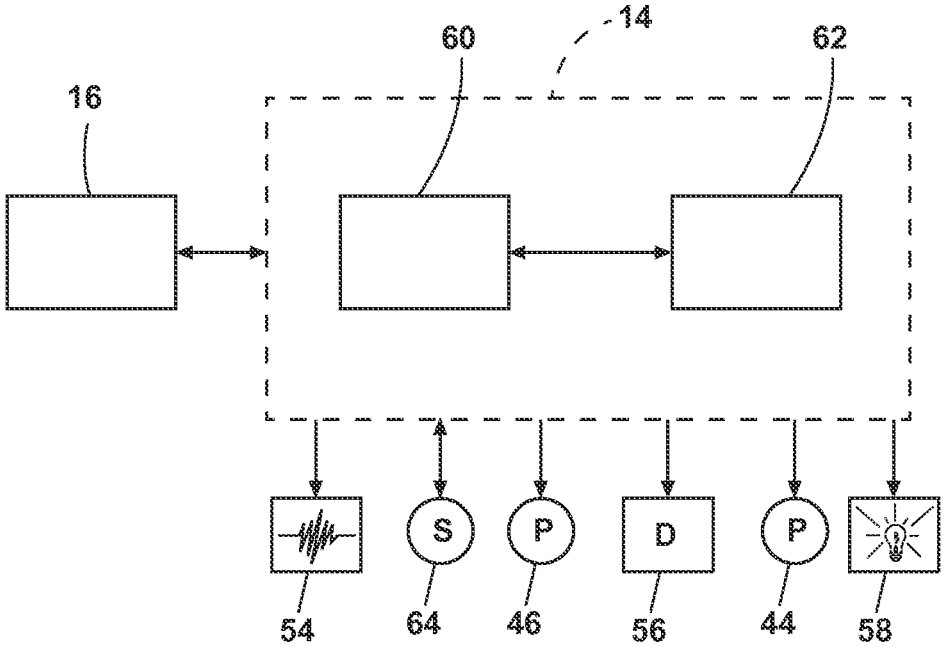
FIG. 2 is a schematic view of a control system of the dishwasher of FIG. 1.

As illustrated in FIG. 2, the controller 14 may be provided with a memory 60 and a central processing unit (CPU) 62. The memory 60 may be used for storing control software that may be executed by the CPU 62 in completing a cycle of operation using the dishwasher 10 and any additional software. For example, the memory 60 may store one or more pre-programmed cycles of operation that may be selected by a user and completed by the dishwasher 10. A cycle of operation for the dishwasher 10 may include one or more of the following steps: a wash step, a rinse step, and a drying step. The wash step may further include a pre-wash step and a main wash step. The rinse step may also include multiple steps such as one or more additional rinsing steps performed in addition to a first rinsing. The amounts of water and/or rinse aid used during each of the multiple rinse steps may be varied. The drying step may have a non-heated drying step (so called "air only"), a heated drying step or a combination thereof. These multiple steps may also be performed by the dishwasher 10 in any desired combination.

The controller 14 may be operably coupled with one or more components of the dishwasher 10 for communicating with and controlling the operation of the components to complete a cycle of operation. For example, the controller 14 may be coupled with the recirculation pump 46 for circulation of liquid in the tub 18 and the drain pump 44 for drainage of liquid in the tub 18. The controller 14 may also be operably coupled to the heater 54, the dispensing system 56, and the light assembly 58. In one example, the controller 14 can be configured to illuminate the light assembly 58 when the door 22 is opened and to turn the light assembly 58 off when the door 22 is closed. Further, the controller 14 can be coupled with the timer to automatically shut off the light assembly 58 if the door 22 remains open for a predetermined period of time. Alternatively or additionally, an operational control for the lighting assembly 58 can be provided on the user interface 16 to allow the user to manually turn the lighting assembly 58 on and off.

The controller 14 may also be coupled with one or more optional sensors 64. Non-limiting examples of optional sensors 64 that may be communicably coupled with the controller 14 include a moisture sensor, a door sensor, a temperature sensor, a detergent and rinse aid presence/type sensor(s). In one example, a door sensor 64 can be provided which provides a signal to the controller 14 when the door is opened or closed in order to control the illumination of the light assembly 58 as described above.

Figure 3:
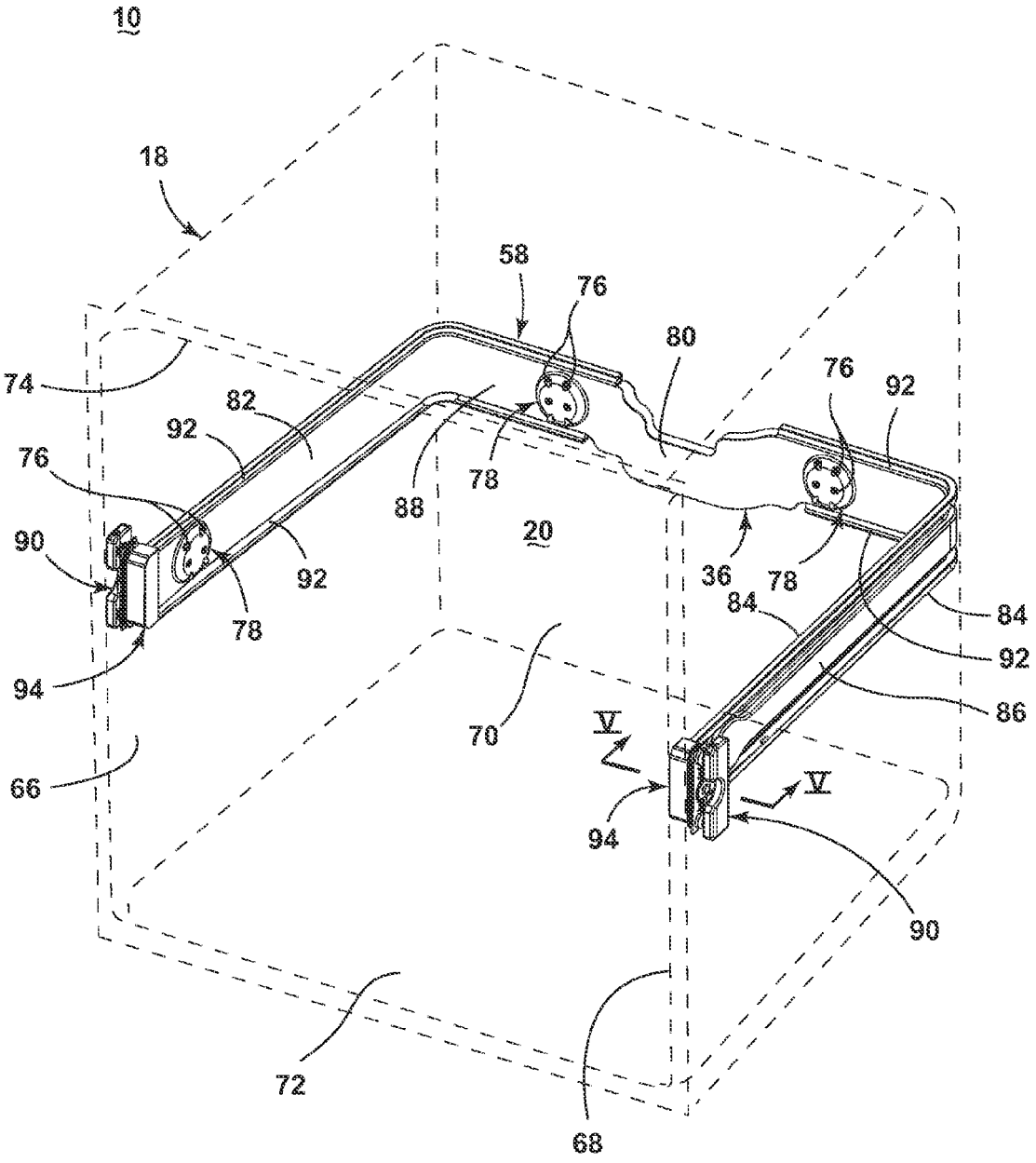
FIG. 3 is a perspective of the dishwasher from FIG. 1, with internal components removed for clarity to show the light assembly.

FIG. 3 is a perspective view of the dishwasher 10 of FIG. 1, illustrating the light assembly 58 on the distribution header 36 within the tub 18, with the tub 18 shown in phantom line and internal components such as the dish racks 24, 26 and sprayers 30, 32, 34 removed for clarity. The tub 18 includes opposing left and right side walls 66, 68 joined by a rear wall 70, a bottom wall 72, and a top wall 74 which together defines the treating chamber 20.

The distribution header 36 has at least one aperture 76 for spraying liquid into the treating chamber 20. The at least one aperture 76 can be provided on at least one nozzle 78 supported by the distribution header 36. The nozzle 78 may be fixed or rotatable with respect to the tub 18. As illustrated herein, the distribution header 36 may include multiple fixed nozzles 78, each having multiple apertures 76 configured to spray wash liquid outwardly from the distribution header 36.

The distribution header 36 extends along at least one wall of the tub 18. As shown herein, the distribution header 36 extends along the rear wall 70 and along at least a portion of the left and right side walls 66, 68. The distribution header 36 can have a generally U-shaped body, with a rear portion 80 extending horizontally along the rear wall 70 of the tub 18 and two side portions 82, 84 extending horizontally along the side walls 66, 68 of the tub 18. The side portions 82, 84 can be substantially flush with the side walls 66, 68 of the tub 18, while the rear portion 80 can have a central bowed portion to accommodate for the supply tube 52 (FIG. 1). As illustrated, two nozzles 78 are provided on the rear portion 80, and one nozzle 78 is provided on each of the side portions 82, 84 (the right side nozzle 78 is not visible in FIG. 3), although other configurations of nozzles 78 are possible.

The distribution header 36 can further include a manifold 86 for providing liquid to the nozzles 78 provided on the distribution header 36. The manifold 86 can be in fluid communication with the supply tube 52 (FIG. 1) for receiving liquid recirculated by the recirculation system, and can define a hollow passage through which liquid may flow to the nozzles 78. In the illustrated embodiment, the manifold 86 is provided on an outer face of the distribution header 36 and, like the distribution header 36, can have a generally U-shape body extending horizontally along the rear wall 70 of the tub 18 and along the side walls 66, 68 of the tub 18. The inner face of the distribution header 36 opposite the manifold 86 forms a cover 88 for the manifold 86. The cover 88 can provide food particles and other debris from getting trapped behind the manifold 86. The manifold 86 and the cover 88 can be integrally formed with each other.

The light assembly 58 includes at least one light source 90 and at least one light guide 92 which is provided on the distribution header 36. The light source 90 is configured to emit light to the light guide 92, which in turn distributes light to the treating chamber 20. The light guide 92 is a device designed to transport and/or distribute light from the light source 90 to a point within the tub 18 at some distance in order to illuminate the treating chamber 20. The distance could be minimal, such as if the light source 90 and light guide 92 were provided on one common wall of the tub 18. Alternatively, the distance could be greater, with the light source 90 provided on one wall of the tub 18 and the light guide 92 provided on or extending to a different wall of the tub 18. Regardless of the distance, the light guide 92 may be uniformly illuminated along its length by the light source 90.

The light guide 92 can be made from polycarbonate, polyester, acrylic, glass, or other optical grade materials suited to withstand the conditions expected inside the dishwasher 10. Furthermore, the light guide 92 can be flexible or rigid. A flexible light guide 92 may be beneficial in allowing allow light transportation at custom angles, which may be beneficial in the dishwasher application shown in the drawings in which the light guide 92 extends over multiple walls of the tub 18.

In one example, the light guide 92 is provided in the form of a light pipe. The light pipe can include an optical fiber or a solid transparent plastic rod for transmitting light lengthwise. While the terms 'pipe' and 'rod' are used herein, it is noted that the light guide 92 is not limited to having an elongated cylindrical shape, but rather can have a variety of shapes and cross sections. The light pipe can have a co-extruded reflector, printing, or etching running the length of the light pipe in order to reflect light out of the light pipe.

As shown herein the light assembly 58 comprises two light sources 90 and four light guides 92, two of which are associated with each light source 90. One light source 90 is associated with the left side wall 66 of the tub 18 and the other light source 90 is associated with the right side wall 68 of the tub 18. For the left light source 90, an upper light guide 92 is provided on an upper portion of the distribution header 36 and a lower light guide 92 is provided on a lower portion of the distribution header 36, and both extend over a portion of the left side wall 66 and the rear wall 70. Likewise for the right light source 90, an upper light guide 92 is provided on an upper portion of the distribution header 36 and a lower light guide 92 is provided on a lower portion of the distribution header 36, and both extend over a portion of the right side wall 68 and the rear wall 70. The upper and lower light guides 92 can be substantially parallel to each other as they extend along the distribution header 36, and can further be substantially coextensive which each other. The light guides 92 illuminate the treating chamber 20, including the dish racks 24, 26 (FIG. 1). The light guides 92 can further be configured to extend adjacent to the nozzles 78 to highlight the spraying features of the distribution header 36.

The light sources 90 can be provided inside or outside of the tub 18. In the illustrated embodiment, the light sources 90 are provided outside the tub 18. More specifically, the light sources 90 are provided outside the left and right side walls 66, 68. End caps 94 attached to the side portions 82, 84 of the distribution header 36 provide at least some mechanical support for the light sources 90. The end caps 94 are provided on the inside of the tub 18.

Figure 4:
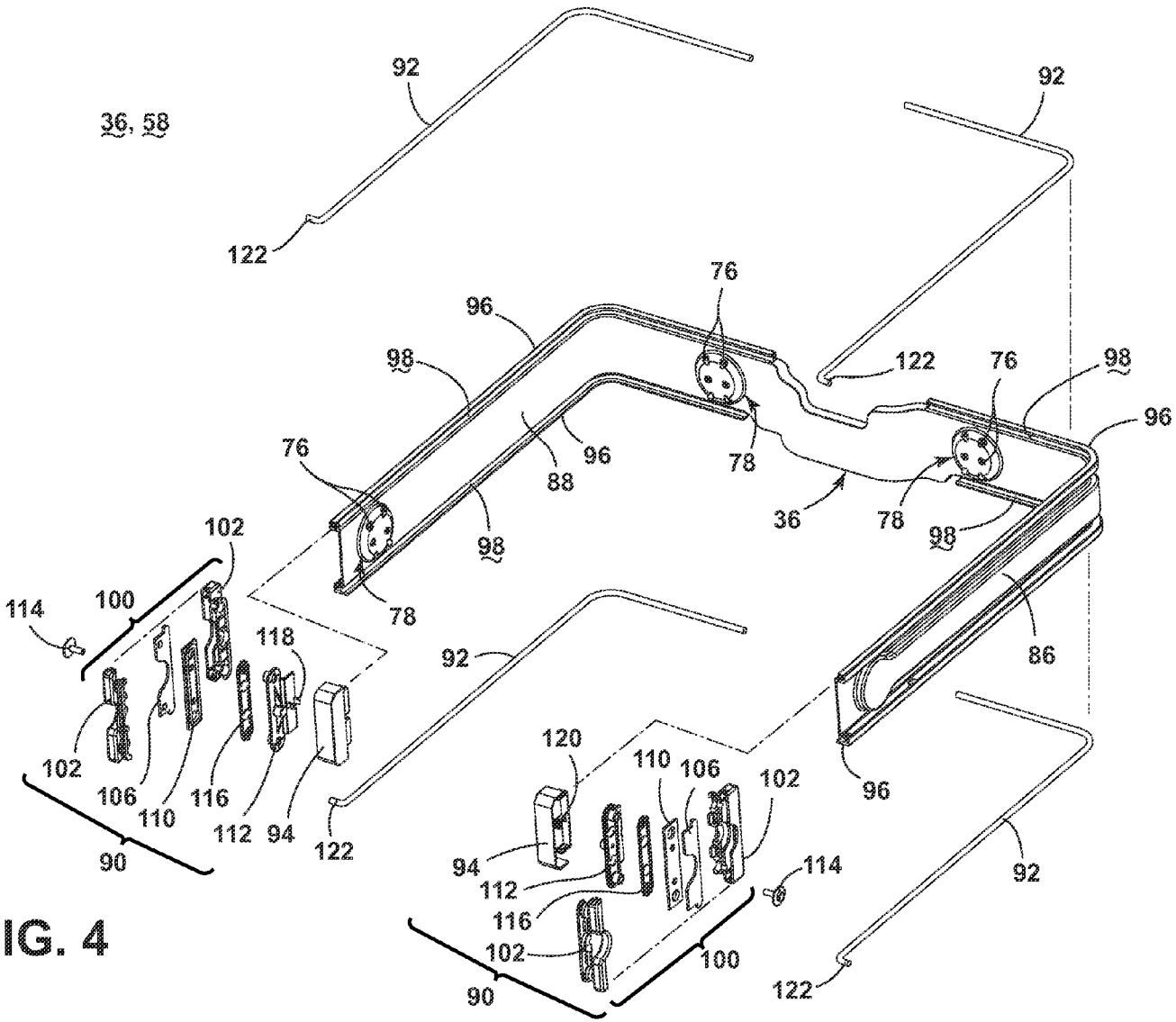
FIG. 4 is an exploded view of the light assembly from FIG. 3.

FIG. 4 is an exploded view of the light assembly 58 from FIG. 3. The distribution header 36 includes at least one seat 96 for mounting the at least one light guide 92. As shown, four seats 96 are provided on the cover 88 of the distribution header to support the four light guides 92, and include L-shaped channels 98 running along the upper and lower edges of the cover 88. The channels 98 for the left light guides 92 can extend along the rear and left side portions 80, 82 of the distribution header 36, while the channels 98 for the right light guides 92 can extend along the rear and right side portions 80, 84 of the distribution header 36.

The light guide seat 96 can be configured to mount the light guide 92 by a friction fit or interference fit. For example, as shown herein the seats 96 are channels 98 having a U-shaped cross-section that are dimensioned with respect to the dimensions of the liquid guide 92 to fasten the light guide 92 to the distribution header 36 by friction when the light guide 92 is pressed into the U-shaped channel 98. Alternatively, the seat 96 can have a snap fit with the light guide 92, with the seat 96 having a protruding part such as a hook, stud, or bead (not shown) that deflects during assembly of the light guide 92 to catch and retain the light guide 92 in the channel 98.

Each light source 90 can include a housing 100 having two mating halves 102 and an end cap cover 104 which is connected to the end cap 94. The housing 100 contains at least one light emitter which emits light toward the light guides 92.

Figure 5:
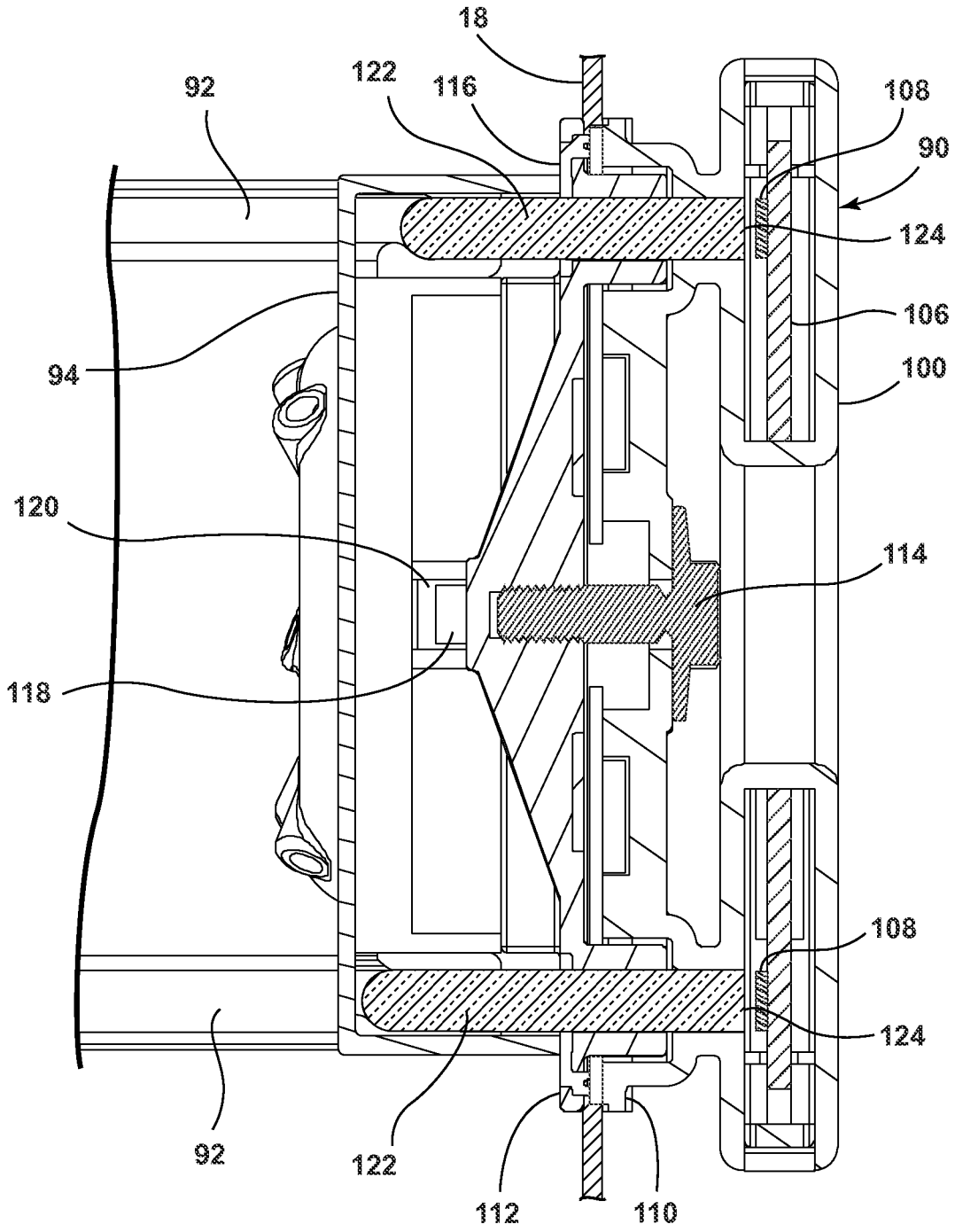
FIG. 5 is a cross-sectional view through line V-V of FIG. 3.

FIG. 5 is a cross-sectional view through line V-V of FIG. 3. As shown, the light emitter can include a printed circuit board (PCB) 106 which has at least one light emitting diode (LED) 108 supported on the PCB 106. The illustrated PCB 106 carries two LEDs 108, one for the upper light guide 92 and one for the lower light guide 92. The PCB 106 can be electrically coupled with the controller 14 for controlling the illumination of the LEDs 108 as described above with reference to FIG. 2.

The mating halves 102 of the housing 100 mate together over the PCB 106, and the housing 100 is mounted to the one of the walls of the tub 18 with the PCB 106 on the exterior of the tub 18. The housing 100 can be attached to the tub 18 by a clamp 110 carried on a portion of the housing 100 and positioned adjacent to the exterior of the tub 18 and an end cap cover 112 which is fastened to the housing 100 by a fastener 114 and positioned adjacent to the interior of the tub 18. The fastener 114 extends through the housing 100, clamp 110, and tub 18 to fasten with the end cap cover 112, essentially clamping the light source 90 to the tub wall.

The end cap cover 112 is coupled with the end cap 94 of the distribution header 36. A gasket 116 can be positioned between the end cap 94 and the end cap cover 112 on the interior of the tub 18 to prevent liquid from entering the light source 90. In one example, the end cap cover 112 can have hooked protrusions 118 which snap into a complementary recess 120 on the end cap 94, although other fastening means are possible.

The light guides 92 have proximal segments 122 which extend into the end caps 94 in order to be in light receiving relationships with their associated light source 90. In the illustrated embodiments, each proximal segment 122 is bent in order to extend through the end cap 94 and into the housing 100 of the light source 90. A terminal end 124 of the proximal segment 122 is adjacent to and in facing relationship with the LED 108 on the PCB 106 in order to receive light emitted by the LED 108.

Figure 6:
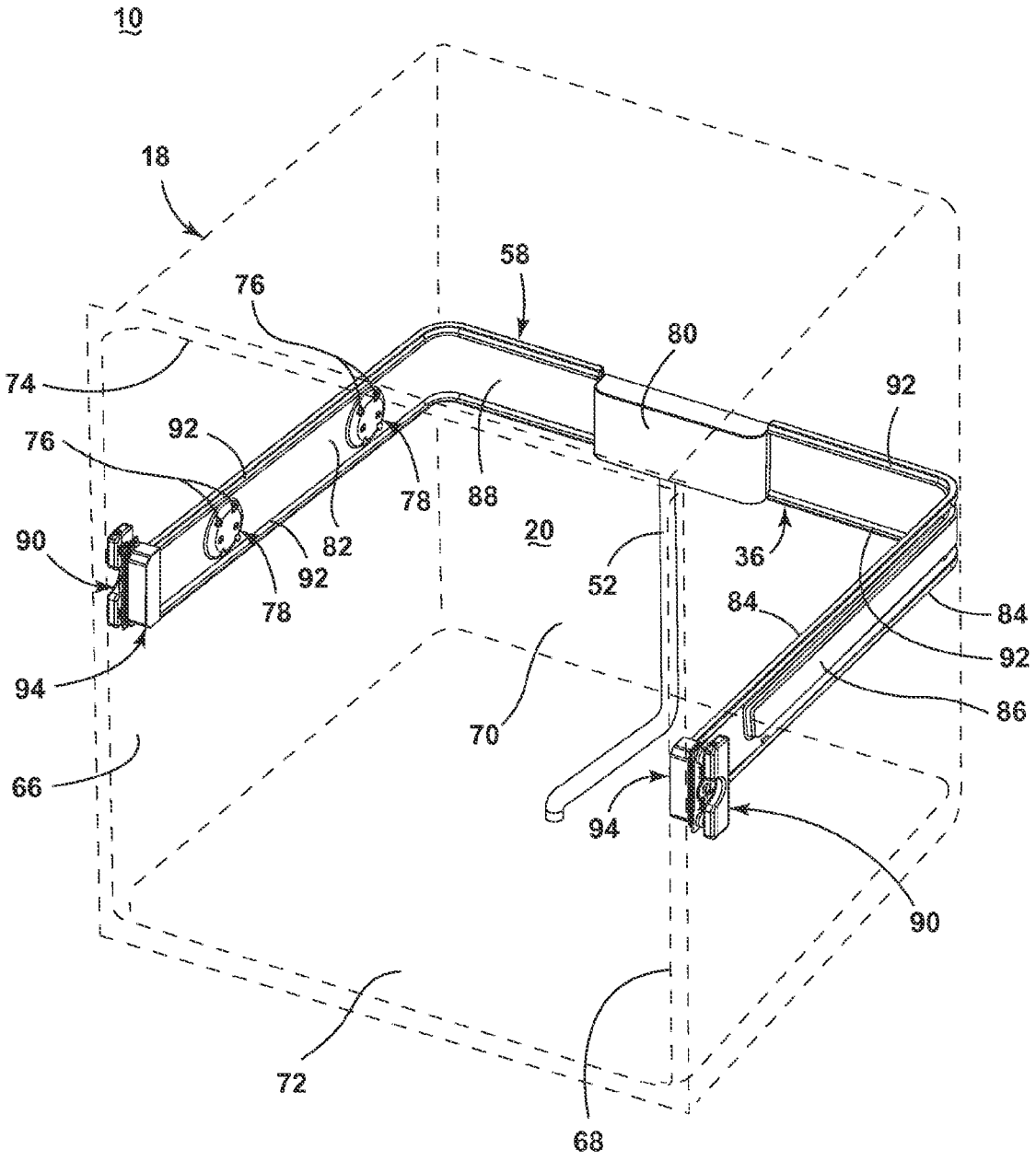
FIG. 6 is a perspective of a dishwasher, with internal components removed for clarity to show a light assembly according to a second embodiment of the invention.

FIG. 6 is a perspective of a dishwasher 10, with internal components removed for clarity to show a light assembly 58 according to a second embodiment of the invention. The second embodiment can be substantially similar to the first embodiment, but differs in the configuration of the distribution header 36 and the nozzles 78. Here, the nozzles 78 are rotatable with respect to the distribution header 36, and are arranged in pairs on the left and right side portions 82, 84 of the distribution header 36, with no nozzles 78 provided on the rear portion 80; however, other arrangements of rotatable nozzles 78 are possible.

Figure 7:
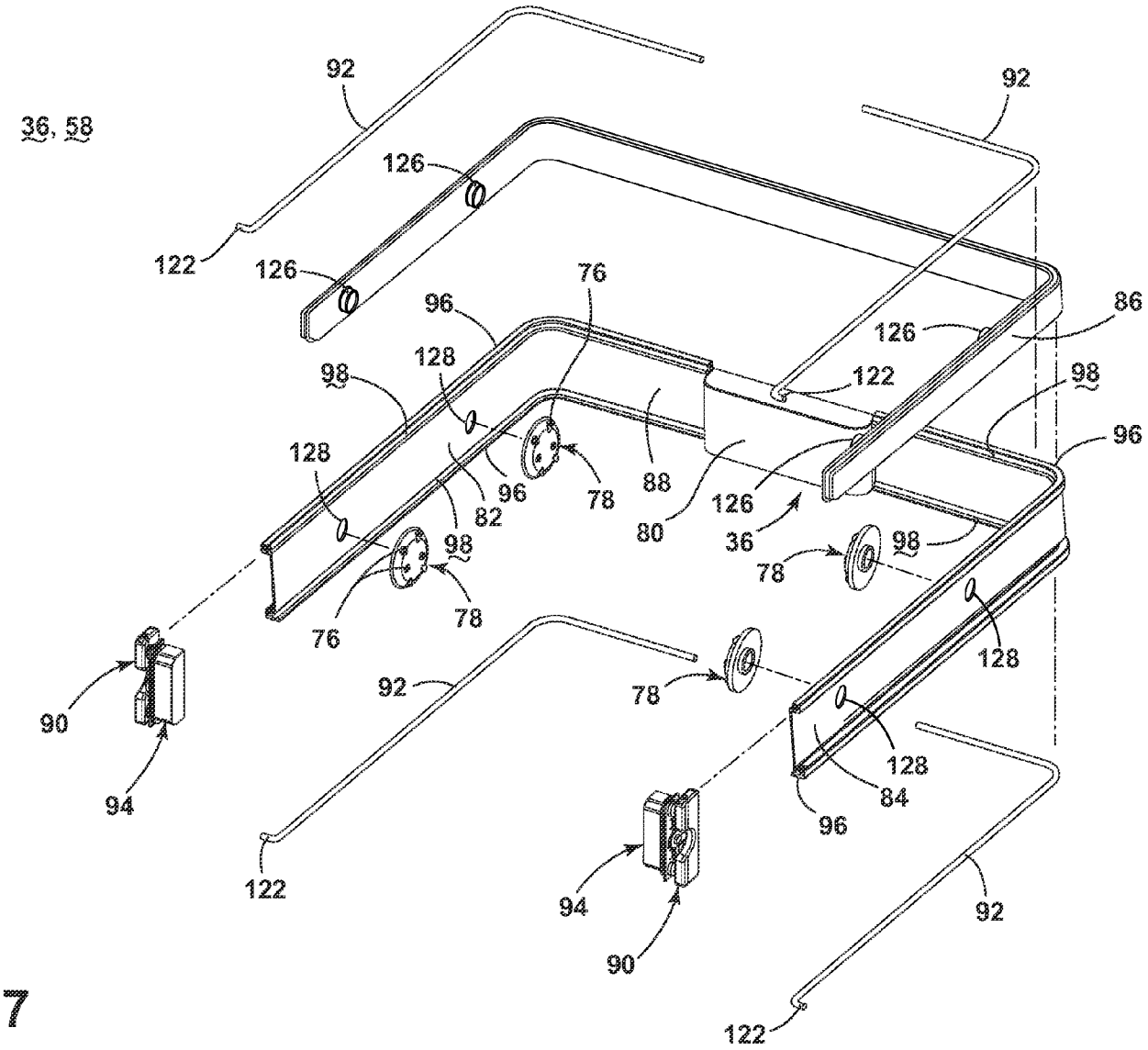
FIG. 7 is an exploded view of the light assembly from FIG. 6.

FIG. 7 is an exploded view of the light assembly 58 from FIG. 6. In the second embodiment the distribution header 36 is provided with a separate manifold 86, such that the manifold 86 and the cover 88 of the distribution header 36 are separately formed, with the manifold 86 provided on the interior of tub 18, and the cover 88 mounted over the manifold 65. The manifold 86 is provided with several ports 126 in fluid communication with the supply tube 52. The ports 126 can protrude through openings 128 the cover 88 in order to couple with and provide fluid to the nozzles 78. The nozzles 78 are rotatably mounted to the manifold 86 such that emission of liquid from the apertures 76 causes the nozzles 78 to spin.

Figure 8:
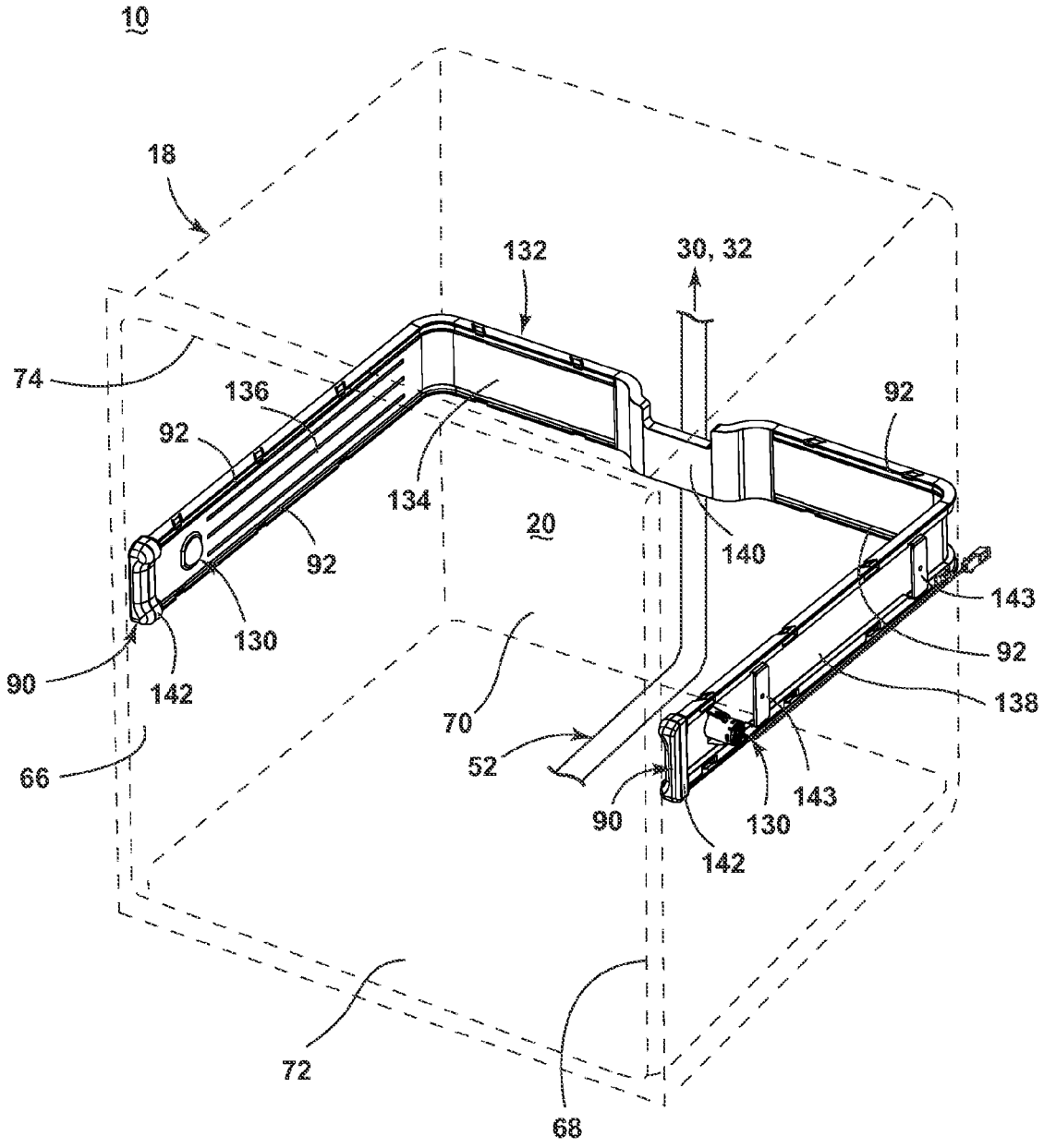
FIG. 8 is a perspective of a dishwasher, with internal components removed for clarity to show a dual light assembly according to a third embodiment of the invention.

FIG. 8 is a perspective of a dishwasher 10, with internal components removed for clarity to show a dual light assembly according to a third embodiment of the invention. The third embodiment can be similar to the first embodiment, but differs in provision of at least one the light source 90 for the light assembly 58 on the inside of the tub 18. Another difference is the provision of an additional light assembly 130 within the treating chamber 20. Furthermore, the light assemblies 58, 130 are not provided on a distribution header for spraying wash liquid into the treating chamber 20, but rather are provided on a lighting mount 132 provided in the tub 18. Of course, it is understood that the light assemblies 58, 130 could be provided on any of the distribution headers 36 disclosed herein.

The lighting mount 132 extends along at least one wall of the tub 18. As shown herein, the lighting mount 132 extends along the rear wall 70 and along at least a portion of the left and right side walls 66, 68. The lighting mount 132 can have a generally U-shaped body, with a rear portion 134 extending horizontally along the rear wall 70 of the tub 18 and two side portions 136, 138 extending horizontally along the side walls 66, 68 of the tub 18. The side portions 136, 138 can be substantially flush with the side walls 66, 68 of the tub 18, while the rear portion 134 can have a central bowed section 140 to accommodate for the supply tube 52 (FIG. 1), which extends past the lighting mount 132 to supply liquid to the upper sprayer 30 and the mid-level sprayer 32. The lighting mount 132 further includes end caps 142 attached to the side portions 136, 138 for supporting the light sources 90 inside the tub 18. In some respects, the lighting mount 132 can be considered to be similar to the cover 88 of the distribution header 36 but without an associated manifold 86.

The lighting mount 132 may be provided anywhere inside the cabinet 12 for supporting the light assembly 58. Similar to the configuration shown in FIG. 1, the light assembly 58 of the third embodiment can be provided between the racks 24, 26 to illuminate both of the racks 24, 26. The lighting mount 132 can be coupled with the tub 18 in any suitable manner; as shown herein, multiple brackets 143 can be used to attach the lighting mount 132 to the tub 18.

Figure 9:
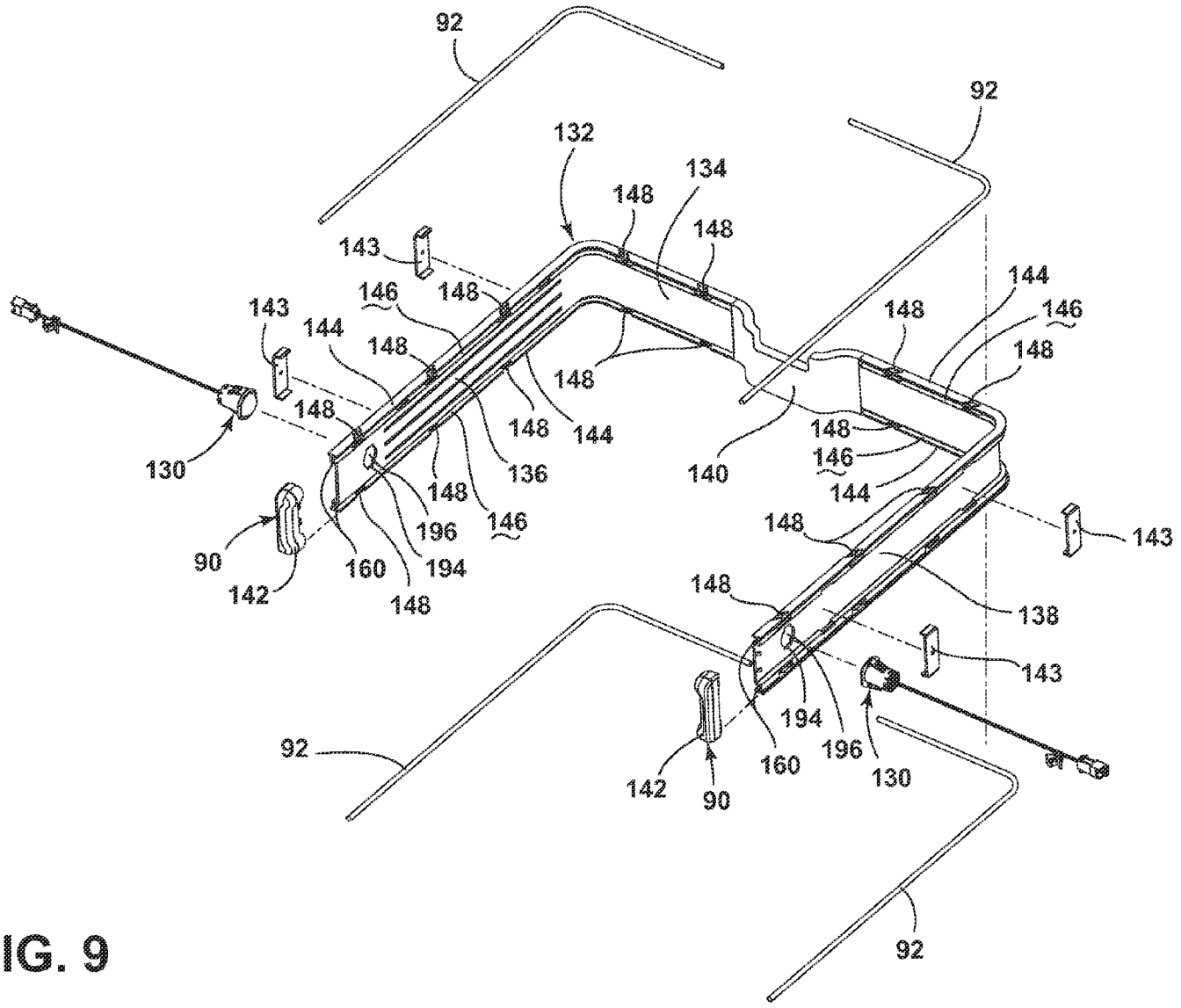
FIG. 9 is a partially exploded view of the dual light assembly from FIG. 8.

FIG. 9 is a partially exploded view of the dual light assembly from FIG. 8. The lighting mount 132 includes at least one seat 144 for mounting the at least one light guide 92. As shown, four seats 144 are provided on the lighting mount 132 to support the four light guides 92, and include L-shaped channels 146 running along the upper and lower edges of the lighting mount 132. The channels 146 for the left light guides 92 can extend along the rear and left side portions 134, 136 of the lighting mount 132, while the channels 146 for the right light guides 92 can extend along the rear and right side portions 134, 138 of the lighting mount 132.

As described above for the first embodiment, the light guide seat 144 can be configured to mount the light guide 92 by a friction/interference fit or snap fit. For example, as shown herein the seat 144 can have a snap fit with the light guide 92, with the seat 144 having a protruding part in the form of a hook 148 that deflects during assembly of the light guide 92 to catch and retain the light guide 92 in the channel 146. Multiple hooks 148 can be provided along the seat 144 to retain the light guide in the channel 146 along its entire length.

Figure 10:
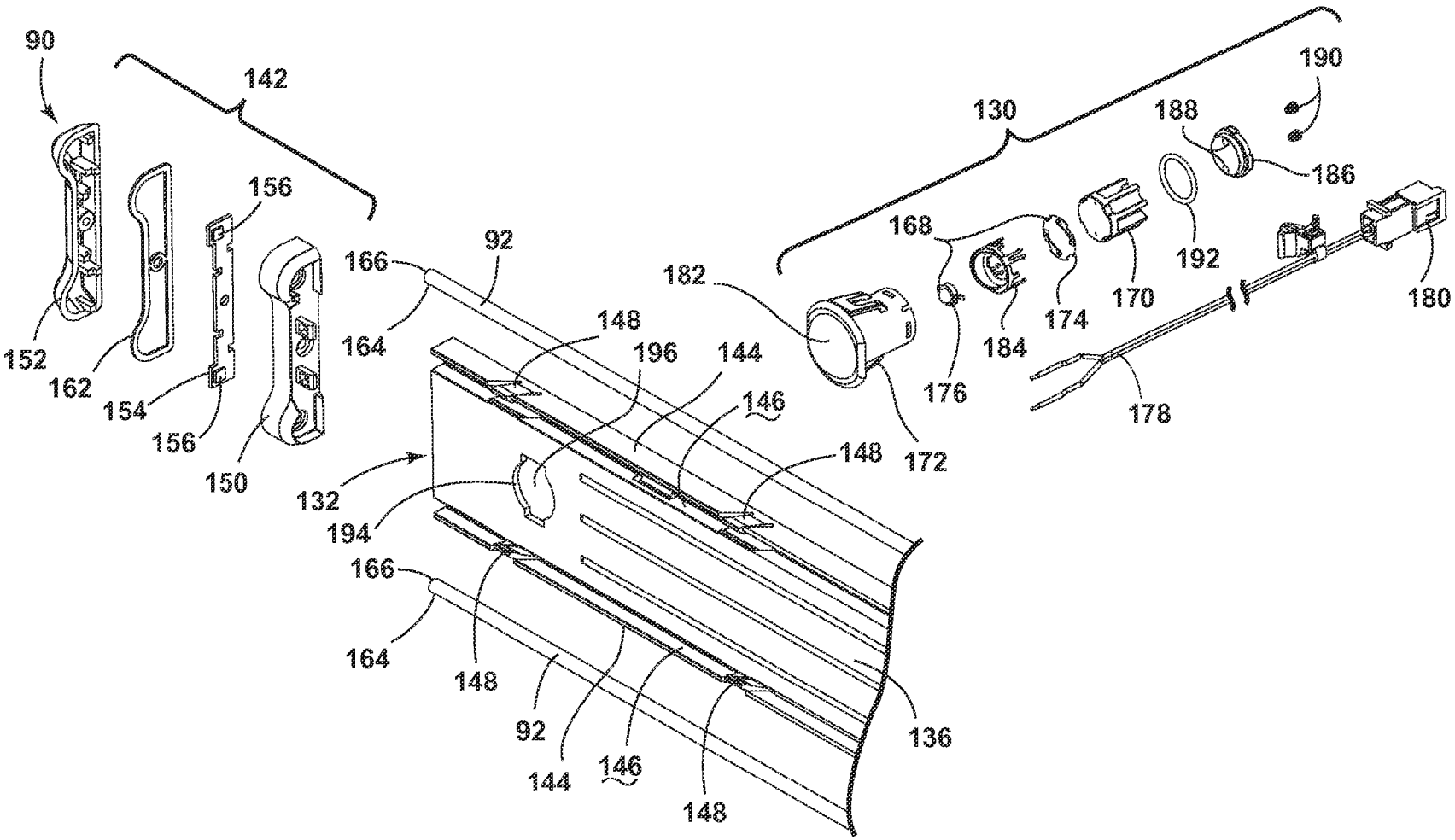
FIG. 10 is a close-up exploded view of the dual light assembly from FIG. 8.

FIG. 10 is a close-up exploded view of the dual light assembly from FIG. 8. The housing for each light source 90 is formed by the end cap 142, which has two mating halves 150, 152. The end cap 142 contains at least one light emitter which emits light toward the light guides 92. As shown, the light emitter can include a printed circuit board (PCB) 154 and at least one light emitting diode (LED) 156 supported on the PCB 154. The illustrated PCB 154 carries two LEDs 156, one for the upper light guide 92 and one for the lower light guide 92. The PCB 154 can be electrically coupled with the controller 14 for controlling the illumination of the LEDs 156 as described above with reference to FIG. 2.

The mating halves 150, 152 of the end cap 142 mate together over the PCB 154, and can be attached to each other by a fastener (not shown) which extends through the mating halves 150, 152. The end cap 142 is in turn coupled with the end of the lighting mount 132 on the interior of the tub 18. In one example, the end cap 142 can have hooks 158 which snap onto a complementary catch 160 (FIG. 9) on the lighting mount 132, although other fastening means are possible. A gasket 162 can be positioned between the mating halves 150, 152 of the end cap 142 on the interior of the tub 18 to prevent liquid from entering the light source 90.

The light guides 92 have proximal segments 164 which extend into the end caps 142 in order to be in light receiving relationships with their associated light source 90. In the illustrated embodiments, each proximal segment 164 is straight since the light source 90 is provided within the tub 18 with the LEDs in axial alignment with portion of the light guides 92 extending along the side walls 66, 68 of the tub 18. A terminal end 166 of the proximal segment 164 is adjacent to and in facing relationship with the LED 156 on the PCB 154 in order to receive light emitted by the LED 156.

The additional light assembly 130 may supplement the light provided by the light assembly 58 and includes at least one light source which is provided on the lighting mount 132. The light source is configured to emit light to the treating chamber 20. The light source can include at least one light emitter 168 which emits light, a housing 170 for the at least one light emitter 168 and a cover 172 which at least partially encloses the housing 170 and covers the at least one light emitter 168. As shown, the light emitter 168 can include a printed circuit board (PCB) 174 and at least one light emitting diode (LED) 176 supported on the PCB 174. Wiring 178 for the LED 176 extends from the PCB 174 out through the housing 170 to a coupler 180 for connecting the LED 176 a source of power, such as the controller 14 (FIG. 2).

The cover 172 can have a lens 182 aligned with the LED 176. The lens 182 can be at least partially transparent or translucent for transmitting light emitted by the LED 176. As illustrated, the cover 172 partially projects through the tub 18 such that the lens 182 is provided on the interior surface of the lighting mount 132.

The PCB 174 can be provided on one end of the housing 170 and mounted to the housing 170 by an emitter seat 184 which overlies the edges of the PCB 174 without blocking light emission from the LED 176. An end cap 186 covers the end of the housing 170 opposite the emitter seat 184, and includes openings 188 for the passage of the wiring 178 out of the housing 170. To prevent liquid from entering the housing 170, seals 190 can be provided in the openings 188 between the wiring 178 and the end cap 186 and a gasket 192 can be provided between the end cap 186 and the housing cover 172.

As shown herein, two additional light assemblies 130 are provided, with one light assembly 130 associated with the left side wall 66 of the tub 18 and the other light assembly 130 associated with the right side wall 68 of the tub 18. The left light assembly 130 can be provided on the left side portion 136 of the lighting mount 132 and the right light assembly 130 can be provided on the right side portion 138 of the lighting mount 132.

The lighting mount 132 includes a one seat 194 for mounting the light assembly 130. As shown, two seats 194 are provided to support the two light assemblies 130, and include openings 196 formed in the side portions 136, 138 of the lighting mount 132 (FIG. 9). The openings 196 can be aligned with corresponding openings (not shown) in the tub 18 for passage of the cover 172 through the tub walls.

The PCB 174 can be electrically coupled with the controller 14 (FIG. 2) for controlling the illumination of the LEDs 176. In one example, the controller 14 can be configured to illuminate the light assembly 130 under the same conditions as the light assembly 58, as described above. Alternatively, an operational control for the lighting assembly 130 can be provided on the user interface 16 to allow the user to manually turn the lighting assembly 130 on and off independently of the lighting assembly 58.

Figure 11:
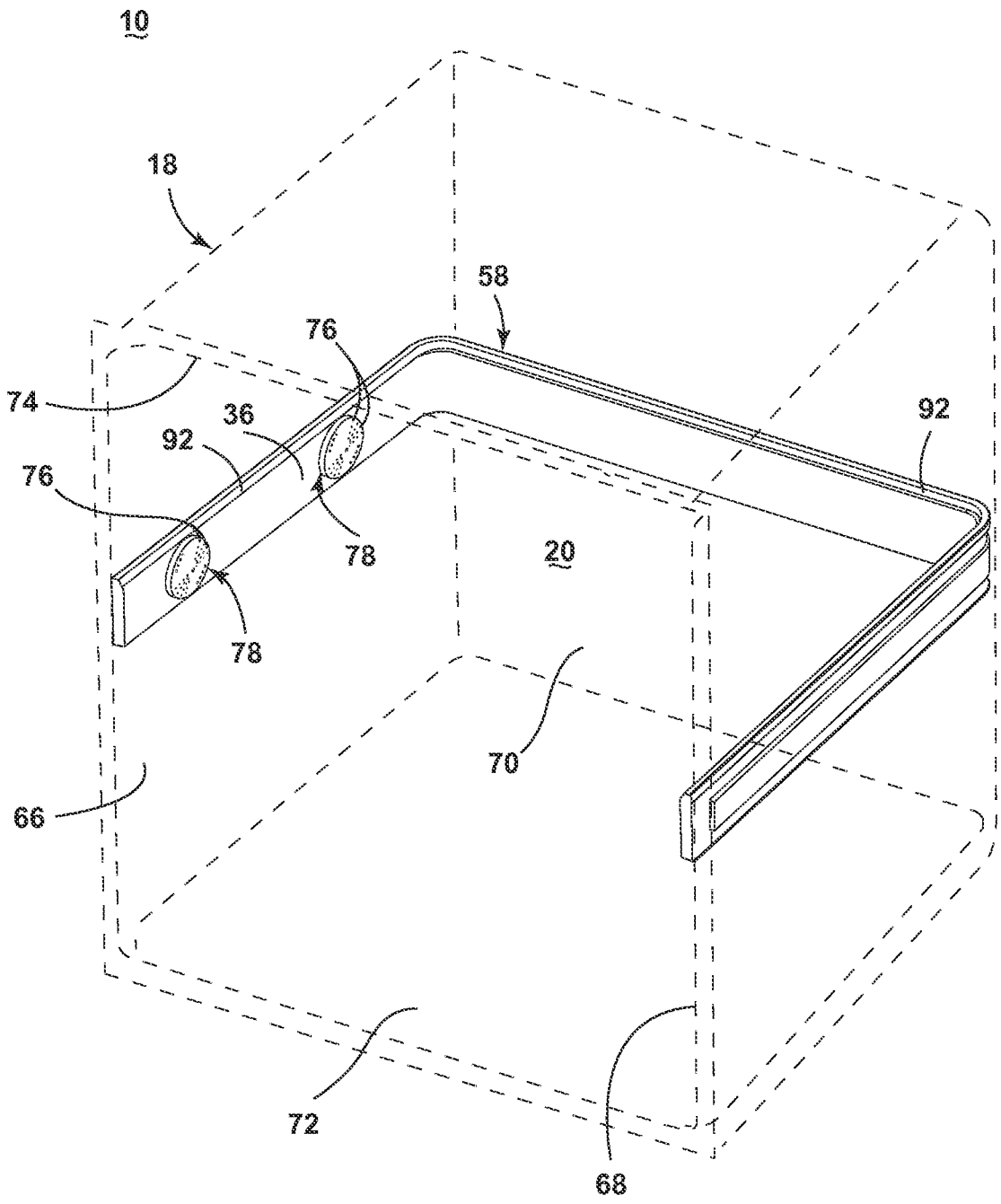
FIG. 11 is a perspective of a dishwasher, with internal components removed for clarity to show a light assembly according to a fourth embodiment of the invention.

FIG. 11 is a perspective of a dishwasher, with internal components removed for clarity to show a light assembly 58 according to a fourth embodiment of the invention. The fourth embodiment differs from the previous embodiments in that a single light guide 92 is provided for illuminating the treating chamber 20. The single light guide 92 may be configured to illuminate one or both of the racks 24, 26 (FIG. 1) in the dishwasher. The single light guide 92 may further have a light source 90 (not shown) which may be outside or inside of the tub 18 as described above for the previous embodiments.

The single light guide 92 is shown as being provided on the upper edge of a distribution header 36, but may be provided on a lighting mount 132 as described for the third embodiment. The distribution header 36 is illustrated as having dual rotating nozzles 78 on each side wall 66, 68 of the tub 18, with only the nozzles 78 on the left side wall 66 being visible in FIG. 11, although other nozzle configurations are possible.

Figure 12:
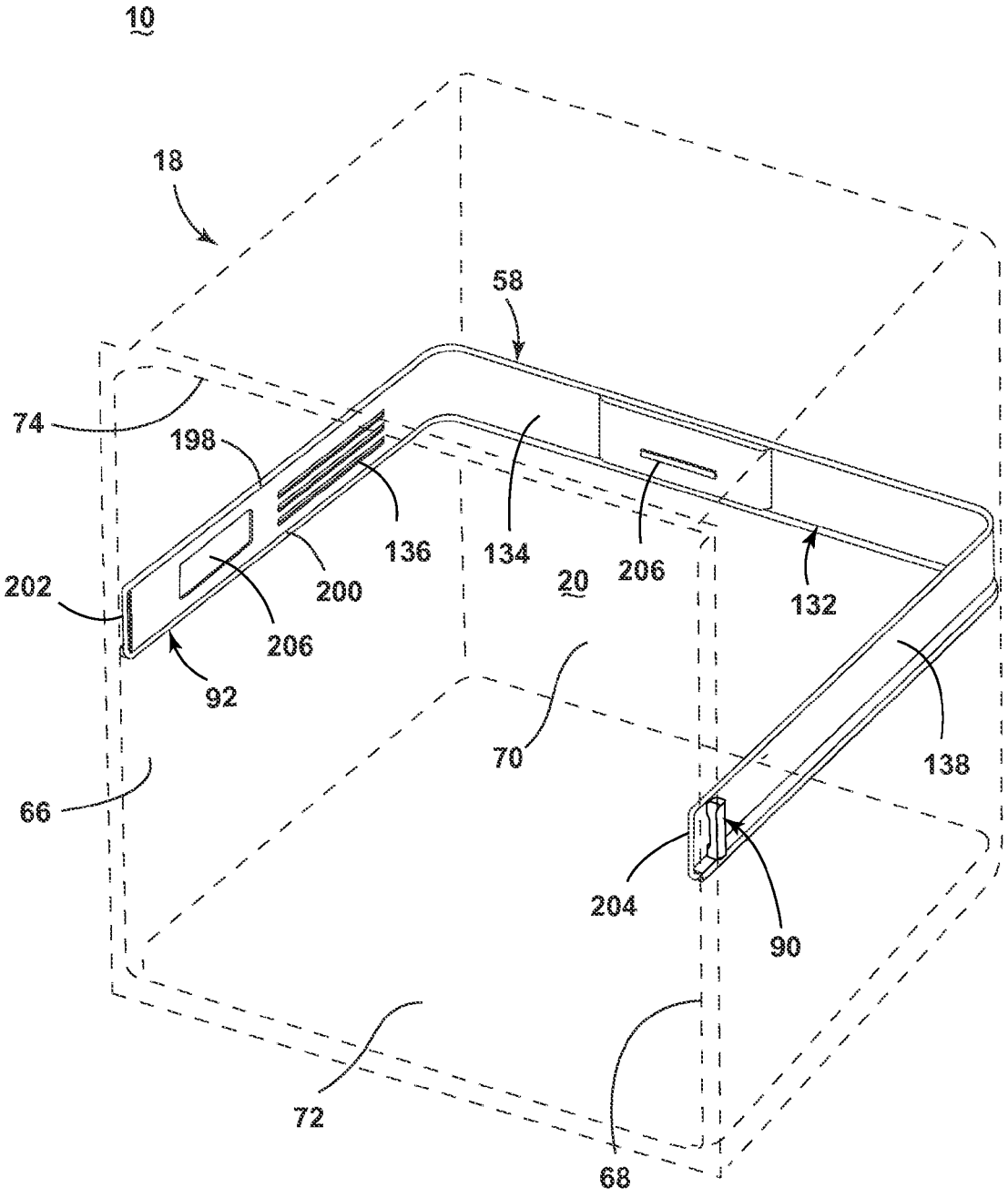
FIG. 12 is a perspective of a dishwasher, with internal components removed for clarity to show a light assembly according to a fifth embodiment of the invention.

FIG. 12 is a perspective of a dishwasher, with internal components removed for clarity to show a light assembly 58 according to a fifth embodiment of the invention. The fifth embodiment differs from the previous embodiments in that a single light guide 92 is provided for illuminating the treating chamber 20, and extends around the lighting mount 132 in a substantially continuous loop. The looped light guide 92 can include an upper segment 198 and a lower segment 200 joint by two end segments 202, 204. As shown herein, the upper segment 198 extends along the upper edge of the lighting mount 132 and the lower segment 200 extends along the lower edge of the lighting mount 132. The lighting mount 132 does not include the end caps 142 to allow the end segments 202, 204 to extend over the ends of the lighting mount 132.

The single light guide 92 may further have a light source 90 which may be outside or inside of the tub 18 as described above for the previous embodiments. The looped light guide 92 is substantially continuous, because the terminal ends (not shown) of the light guide do not meet. A proximal segment of the light guide 92 is configured to be adjacent the light source such that its terminal end is adjacent to and in facing relationship with the light source in order to receive light emitted by the light source. The distal end of the light guide does not meet the proximal end, but may appear to meet or almost to meet the proximal end when the light guide 92 is illuminated Alternatively to being provided on a lighting mount 132, the looped light guide 92 may be provided on a distribution header 36 as described for the first and second embodiments. The single light guide 92 may be configured to illuminate one or both of the racks 24, 26 (FIG. 1) in the dishwasher, and may further emit light out of the treating chamber 20 by the end segments. The fifth embodiment further includes one or more additional light assemblies 206 which emit light into the treating chamber 20.

Figure 13:
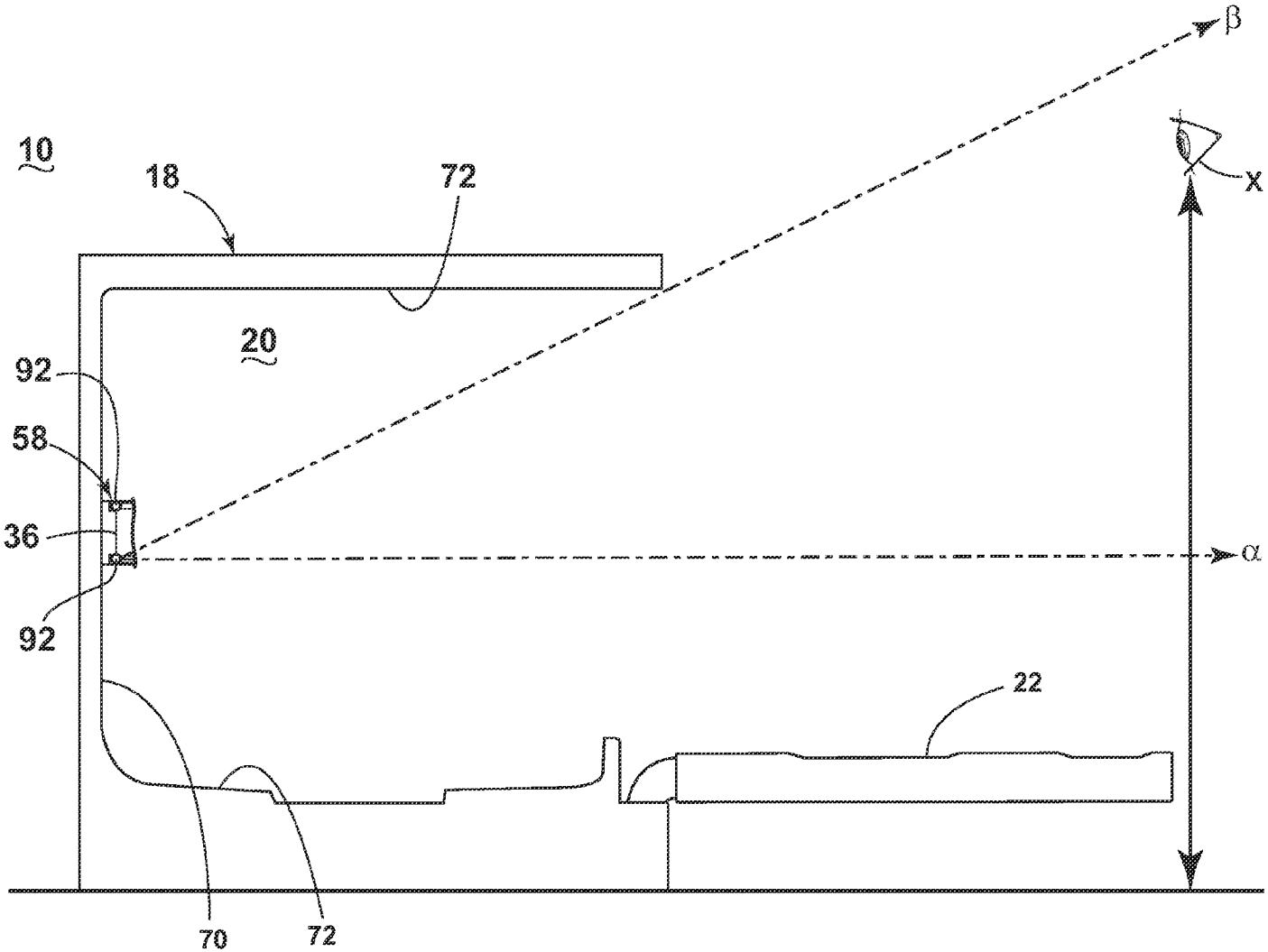
FIG. 13 is a schematic view illustrating a viewing angle for the light assembly of the first embodiment of the invention.

FIG. 13 is a schematic view illustrating a viewing angle for the light assembly 58 of the first embodiment of the invention. While shown with respect to the first embodiment, the viewing angle schematic is applicable to any of the embodiments discussed herein. The light guide 92 can be configured to emit light at a desired viewing angle or range of viewing angles $\alpha$-$\beta$. The viewing angle can be measured from a coordinate system conceptually applied to the light guide at an inner, upper quadrant of the light guide with respect to the tub wall on which the light guide is provided. The light guide 92 can have a range of viewing angles, such that a user looking at the light pipe 92 at an orientation outside the minimum viewing angle $\alpha$ and the maximum viewing angle $\beta$ will not see the illuminated light pipe. Some non-limiting examples of suitable viewing angles can range between 0 and 50 degrees, or between 15 and 45 degrees, or between 20 and 35 degrees, relative to the horizontal axis of the coordinate system.

The viewing angle or range of viewing angles can be configured for a user X of average expected height or within a range of average expected heights standing an expected distance within a range of distances from the light assembly 58. For example, it may be expected that a user will stand in front of the dishwasher 10 with the door 22 open. A typical household dishwasher falls within a conventional set of dimensions; for example the height of the dishwasher may be approximately 34 inches, the height of the lower light guide 92 may be approximately 17 inches, the distance between the rear wall 70 and the open face of the treating chamber 20 may be approximately 24 inches, while the combined length of the bottom wall 72 and open door 22 may be approximately 54 inches.

The viewing angle can vary based on the configuration of the light guide 92. For a light guide in the form of a light pipe, the light pipe can be doped to produce varying viewing angles. Features such as a co-extruded reflector, printing, or etching running the length of the light pipe can also affect the viewing angle. A light pipe with a co-extruded reflector may have a maximum viewing angle of 15 degrees, while a light pipe with printing may have a maximum viewing angle of 30 degrees.

There are several advantages of the present disclosure arising from the various features of the apparatuses described herein. For example, the embodiments of the invention described above allows for illumination of the interior of the tub which is both sufficient to light the racks 24, 26 and highlight components of the spraying system 28.

Another advantage of some of the embodiments of the invention described above is that a single LED can be fired into a light guide to illuminate a large area of the tub 18. By only requiring one LED to illuminate each light guide, a minimal area is required to be sealed to prevent liquid from reaching the electronics.

Yet another advantage of some of the embodiments of the invention described above is that the light assembly can be integrated into a manifold of the spraying system which emits a spray of liquid into the treating chamber. This minimizes the number of different components needed for the lighting assembly and the spraying system in that a unique or separate mount for the lighting assembly is not required. Also by placing the lighting assembly on the manifold, the manifold can be aesthetically illuminated to highlight the features of the manifold.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A dishwasher for treating dishes according to an automatic cycle of operation, comprising:

a tub at least partially defining a treating chamber and having two side walls connected to a rear wall and an open face providing access to the treating chamber;

a cover selectively closing the open face;

a spraying system comprising:

a distribution header fixedly mounted to the tub within the treating chamber and comprising a generally U-shaped planar body having a rear portion extending along the rear wall and two side portions extending along the two side walls; and at least one aperture provided on the distribution header for spraying wash liquid into the treating chamber;

a recirculation system for recirculating liquid sprayed in the treating chamber to the spraying system; and a light assembly comprising a first light source and a first light guide provided on the planar body of the distribution header and extending along the rear portion and at least one of the two side portions;

wherein the first light source emits light to the first light guide and first light guide distributes light to the treating chamber.

2. The dishwasher of claim 1, wherein the light assembly further comprises a second light source and a second light guide provided on the distribution header and extending along the rear portion and at least one of the two side portions, wherein the second light source emits light to the second light guide and the second light guide distributes light to the treating chamber.

3. The dishwasher of claim 2, wherein the first light guide is parallel to the second light guide.

4. The dishwasher of claim 1 and further comprising a lower dish rack located within the treating chamber and an upper dish rack located within the treating chamber above the lower dish rack, wherein the light guide is provided between the lower and upper dish racks.

5. The dishwasher of claim 4, wherein the light guide is configured to emit light onto both the lower and upper dish racks.

6. The dishwasher of claim 1 and further comprising an end cap attached to an end of the distribution header, wherein the light source is mounted to the end cap.

7. The dishwasher of claim 6, wherein one end of the light guide extends into the end cap.

8. The dishwasher of claim 6, wherein the light source comprises a printed circuit board mounted to the end cap, and at least one LED provided on the printed circuit board.

9. The dishwasher of claim 1, wherein the distribution header comprises a light guide seat, and the light guide is mounted to the light guide seat by a friction or snap fit.

10. The dishwasher of claim 1, wherein the light guide comprises a light pipe.

11. The dishwasher of claim 10, wherein the light pipe comprises one of a co-extruded reflector, printing, or etching running the length of the light pipe.

12. The dishwasher of claim 1, wherein the light source comprises at least one light emitting diode.

13. The dishwasher of claim 1, wherein the light source is located inside the tub.

14. The dishwasher of claim 1, wherein the light source is located outside the tub.

15. The dishwasher of claim 1, wherein the distribution header comprises a manifold and at least one nozzle fluidly coupled to the manifold and having the at least one aperture.

16. The dishwasher of claim 15, wherein the manifold extends along both of the side walls and the rear wall.

17. The dishwasher of claim 16, wherein the distribution header comprises multiple nozzles fluidly coupled to the manifold, with at least one of the multiple nozzles provided on the rear wall and the side walls.

18. The dishwasher of claim 15, wherein the recirculation system comprises a supply tube extending to the manifold to supply liquid to the at least one nozzle.

19. The dishwasher of claim 15, wherein the distribution header further comprises a cover extending over the manifold, and the light guide is supported by the cover.

20. The dishwasher of claim 2, wherein the first light guide extends along a top edge of the distribution header and the second light guide extends along a bottom edge of the distribution header.

* * * * *